US008696104B1

(12) United States Patent
de Jong et al.

(10) Patent No.: US 8,696,104 B1
(45) Date of Patent: Apr. 15, 2014

(54) MOTION QUALITY IMPROVEMENT BY FEED-FORWARD TORQUE CONTROL OF IMAGING DRUM

(71) Applicant: Xerox Corporation, Norwalk, CT (US)

(72) Inventors: Joannes N. M. de Jong, Hopewell Junction, NY (US); Roger G. Leighton, Hilton, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 13/652,799

(22) Filed: Oct. 16, 2012

(51) Int. Cl.
*B41J 2/01* (2006.01)
*G03G 15/00* (2006.01)

(52) U.S. Cl.
USPC ..... 347/103; 399/396

(58) Field of Classification Search
USPC ..... 347/5, 14, 16, 19, 101–104; 399/394, 399/395, 396
See application file for complete search history.

(56) References Cited

U.S. PATENT DOCUMENTS

| | | | | |
|---|---|---|---|---|
| 5,864,774 | A * | 1/1999 | Jones | 702/94 |
| 6,731,891 | B1 | 5/2004 | Calamita et al. | |
| 7,065,308 | B2 | 6/2006 | Calamita et al. | |
| 7,860,417 | B2 * | 12/2010 | Jones et al. | 399/66 |

* cited by examiner

*Primary Examiner* — Anh T. N. Vo
(74) *Attorney, Agent, or Firm* — Hoffmann & Baron, LLP

(57) ABSTRACT

A printer having an imaging drum rotatable around its longitudinal axis, receives a pattern of ink corresponding to an image to be printed. A transfix roller rotates around its longitudinal axis, and is selectively held against the imaging drum by a transfix force, the interface of the imaging drum and the transfix roll forms a transfix nip. An image is formed on the substrate passed through the transfix nip by the marking ink on the imaging drum. A motor drives the imaging drum through a power train with a speed and direction controlled by a motor drive unit. A substrate sensor detects the substrate at the transfix nip, and outputs a signal to the motor drive. The motor drive varies the torque applied to the imaging drum in response to the signal, to maintain a constant rotational speed of the imaging drum.

17 Claims, 3 Drawing Sheets

MOTION QUALITY IMPROVEMENT BY FEED-FORWARD TORQUE CONTROL OF IMAGING DRUM

BACKGROUND

1. Field of the Disclosure

The present disclosure relates document creation. More specifically, the present disclosure is directed to a system and method for managing torque applied to an imaging drum of a direct transfer marking system.

2. Brief Discussion of Related Art

One particularly promising technology for forming documents of cut sheet print media includes a solid ink-based printer. A document image is formed on an imaging drum using a solid, e.g., wax-based, ink. The image is the transfixed onto the print medium, the print medium being passed between the imaging drum and a transfix roller and pressed between the imaging drum and transfix roller with considerable force. One embodiment of such solid wax technology has the solid wax ink fixed on the imaging drum in a first revolution of the imaging drum before the print media is introduced into the nip between the imaging drum and the transfix roller. The document is then printed and passed from the image transfix nip before the next document image is begun, necessitating another revolution of the imaging drum.

As the transfix roller remains engaged with the imaging drum, when a sheet enters the nip (approximately 10 mm wide) a climb or fall torque disturbance occurs at the same time while printing with the imaging heads. The torque disturbance causes the drum to change velocity, which will introduce a motion artifact in the image at both the lead-in (climb) and trail edge (fall) of the paper. This disturbance only becomes an issue if it is attempted to begin forming an image of a next document on the imaging drum while the last document media is being printed in the nip. One solution is the two-pass process described above, however this slows the maximum throughput volume of the printer.

However, the general process shows promise, and further improvement in the art is still wanting.

SUMMARY

Proposed according to the present disclosure is a document system capable of document production volumes up to 250 pages per minute (ppm). This technology involves a single pass engine with 20 print heads arrayed about the drum. The image drum is turned at 41.6 inches per second (ips) surface speed. There is a 3-step printing process, namely oiling, imaging, and transfixing. The force applied to transfix the image onto a drum is roughly 3880 lb.

The present disclosure proposes to supply an auxiliary torque to the imaging drum upon media entry/exit to compensate for anticipated motion disturbances due to the media entry/exit. A substrate sensor is provided at the transfix nip to detect the entry/exit time of the media.

In order to overcome the drawbacks in the present art, provided according to the present disclosure is a printer for the direct marking of document images on a substrate, the printer having an imaging drum mounted for rotation around its longitudinal axis, operative to receive a pattern of marking ink corresponding to an image to be printed on the substrate. A transfix roller is mounted for rotation around its longitudinal axis, and is selectively held against the imaging drum by a transfix force, the interface of the imaging drum and the transfix roller forming a transfix nip having a nip width, wherein an image is formed on the substrate passed through the transfix nip by the marking ink deposited on the imaging drum. A motor drives the imaging drum through a power train with a speed and direction controlled by a motor drive unit. A substrate sensor detects the substrate entering into or exiting from the transfix nip, and outputs a signal to the motor drive unit based upon the detection. The motor drive varies the torque applied to the imaging drum in response to the signal from the substrate sensor sufficient to maintain a constant rotational speed of the imaging drum notwithstanding the substrate passing through the transfix nip. In certain embodiments of the present disclosure, the transfix roller may be idle, and rotated by engagement with the imaging drum.

In certain embodiments of the present disclosure, the substrate sensor is a photoelectric or proximity sensor, and is positioned to detect the presence of the substrate crossing a detection threshold upstream in a process direction from the transfix nip. In certain embodiments, the motor drive varies the timing of the motor drive response to the signal output from the substrate sensor, corresponding the variation in applied torque to coincide with the substrate entering into or exiting from the transfix nip, based upon a distance between the sensing threshold and a presumed or measured speed of the substrate in the process direction. Alternately or additionally, the substrate sensor varies the timing of the signal output from the substrate sensor, corresponding the signal output to coincide with the substrate entering into or exiting from the transfix nip, based upon a distance between the sensing threshold and a presumed or measured speed of the substrate in the process direction.

In certain embodiments of the present disclosure the longitudinal axis of the transfix roller is skewed relative to the longitudinal axis of the imaging drum, placing a first end of the transfix roller upstream in the process direction compared with an opposite second end of the transfix roller. The angle of skew may be about 2 degrees. In those embodiments, the substrate sensor may be configured to detect the substrate entering into or exiting from the transfix nip at the first upstream end of the transfix roll.

In still other embodiments of the present disclosure the substrate sensor is operative to detect a change in the dimension of the transfix nip resulting from the substrate entering into or exiting from the transfix nip. Among these, the transfix roller may include a material that exhibits varying electrical properties according to its state of compression, and the substrate sensor detect the variable electrical properties of the transfix roller.

Alternately or additionally, in still further embodiments, the printer includes an engagement frame, with the transfix roller rotatably mounted to the engagement frame. An actuator acts on the engagement frame to press the transfix roller into engagement with the imaging drum. In others of these embodiments, the substrate sensor detects strain in the engagement frame related to the substrate entering into or exiting from the transfix nip.

Alternately or additionally, the substrate sensor detects force feedback in the actuator related to the substrate entering into or exiting from the transfix nip. Wherein the actuator is driven by a motive fluid, and the force feedback detected by the substrate sensor may be a variation in the motive fluid pressure. Where the actuator is driven by electric power, and the force feedback detected by the substrate sensor may be a variation in the amperage drawn by the actuator.

The motor drive may respond to signal output from the substrate sensor corresponding with a leading edge of the substrate entering into the transfix nip by increasing the torque applied to the imaging drum in an amount corresponding to the work required to separate the transfix nip by the thickness of the substrate in the time required for the leading edge to cross the nip width at the velocity of the substrate in the process direction. Alternately or additionally, the motor drive responds to signal output from the substrate sensor corresponding with a trailing edge of the substrate exiting from the transfix nip by decreasing the torque applied to the imaging drum in an amount corresponding to the work required to close the transfix nip by the thickness of the substrate in the time required for the trailing edge to cross the nip width at the velocity of the substrate in the process direction.

These and other purposes, goals and advantages of the present application will become apparent from the following detailed description of example embodiments read in connection with the accompanying drawings.

BRIEF DESCRIPTION OF THE DRAWINGS

Some embodiments are illustrated by way of example and not limitation in the figures of the accompanying drawings in which.

DETAILED DESCRIPTION

Introduction

As used herein, a "printer" refers to any device, machine, apparatus, and the like, for forming images on substrate media using ink, toner, and the like. A "printer" can encompass any apparatus, such as a copier, bookmaking machine, facsimile machine, multi-function machine, etc., which performs a print outputting function for any purpose. Where a monochrome printer is described, it will be appreciated that the disclosure can encompass a printing system that uses more than one color (e.g., red, blue, green, black, cyan, magenta, yellow, clear, etc.) ink or toner to form a multiple-color image on a substrate media.

As used herein, "substrate media" refers to a tangible medium, such as paper (e.g., a cut sheet of paper, a long web of paper, a ream of paper, etc.), transparencies, parchment, film, fabric, plastic, paperboard or other substrates on which an image can be printed or disposed.

As used herein "process path" refers to a path traversed by a unit of substrate media through a printer to be printed upon by the printer on one or both sides of the substrate media. A unit of substrate media moving along the process path from away from its beginning and towards its end will be said to be moving in the "process direction".

DESCRIPTION

Figure 1:
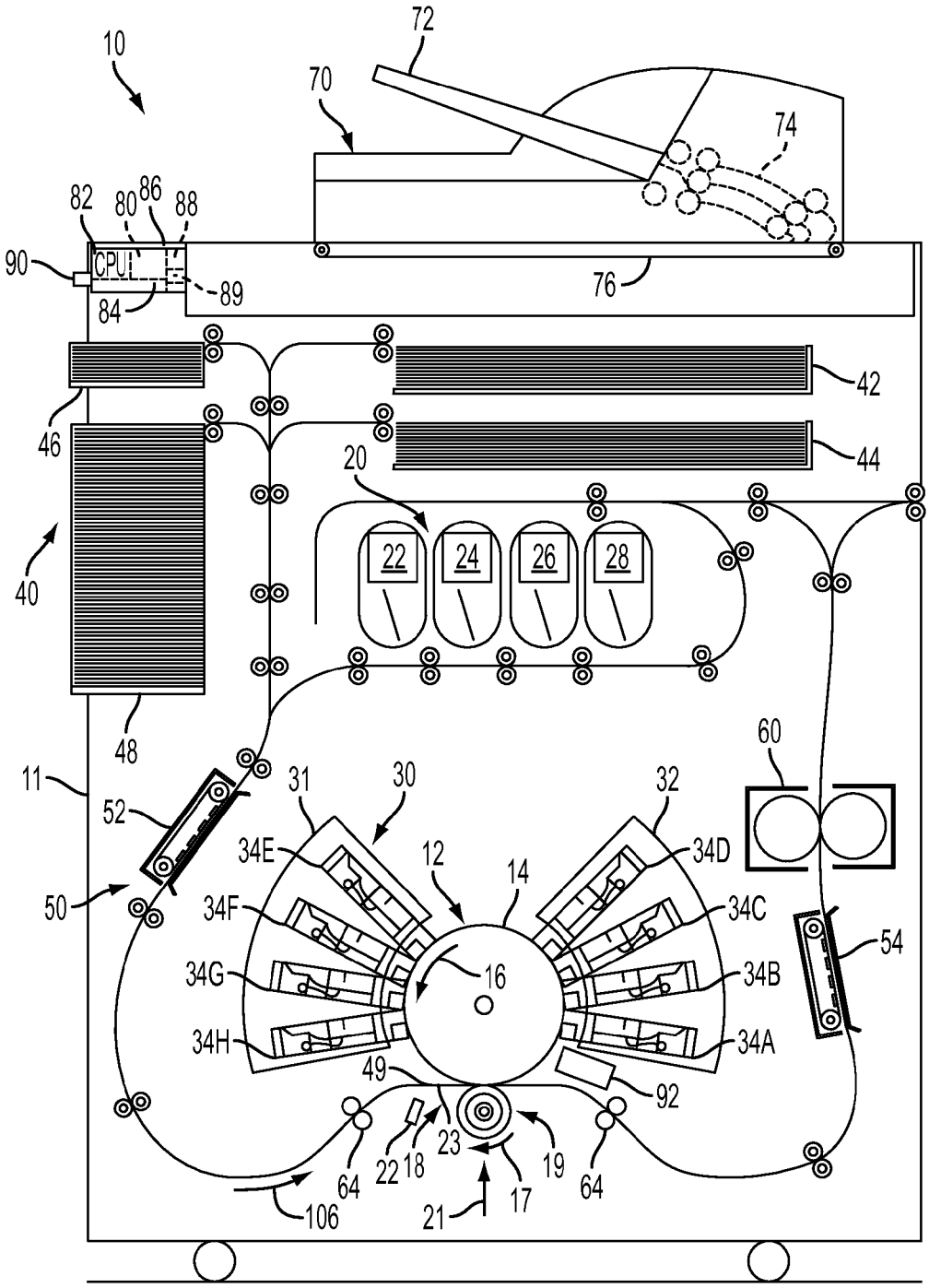
FIG. 1 illustrates schematically the working components of a printer according to an embodiment of the present disclosure.

FIG. 1 illustrates a high-speed image producing machine or printer 10. As illustrated, the printer 10 includes a frame 11 supporting directly or indirectly operating subsystems and components, as described below. The printer 10 includes an image receiving member 12 that is shown in the form of a drum (hereinafter imaging drum 12), but can also include a supported endless belt. The imaging drum 12 has an imaging surface 14 that is movable in a direction indicated by arrow 16, and on which images are formed. A transfix roller 19 rotatable in the direction 17 is loaded against the surface 14 of drum 12 with a force indicated by arrow 21. In one embodiment, this force 21 is on the order of about 20 kN, though it may be greater of less. The meeting of imaging drum 12 and transfix roller 19 forms a transfix nip 18, within which ink images formed on the surface 14 are transfixed onto a substrate media 49. In certain embodiments, a substrate sensor 22 (e.g., photoelectric, proximity, etc., without limitation) is positioned to detect the presence of the substrate media 49 at the transfix nip 18.

The high-speed printer 10 also includes an ink delivery subsystem 20 that has at least one source 22 of one color ink in solid form. Where the printer 10 is a multicolor image producing machine, the ink delivery system 20 includes multiple, in this case four (4), sources 22, 24, 26, 28, representing four (4) different colors of inks, e.g., CYMK (cyan, yellow, magenta, black). The ink delivery subsystem 20 also includes a melting and control apparatus (not shown) for melting or phase changing the solid form of the ink into a liquid form. The ink delivery subsystem 20 is suitable for supplying the liquid form to a printhead system 30.

In this embodiment, the printhead system 30 includes a first printhead support 31 and a second printhead support 32 each of which provides support for a plurality of printhead modules 34A through 34H, also known as print box units. Each printhead module 34A-34H effectively extends across the width of the media and deposits ink onto the surface 14 of the imaging drum 12. A printhead module can include a single printhead or a plurality of printheads in a staggered arrangement that are operatively connected to a frame (not shown) and aligned to deposit the ink to form an ink image on the surface 14. The printhead modules 34A-34H can include associated electronics, ink reservoirs, and ink conduits to supply ink to the one or more printheads. In this embodiment however, conduits (not shown) operatively connect the sources 22, 24, 26, and 28, to the printhead modules 34A-34H to provide a supply of ink to the one or more printheads in the module.

As is generally familiar, the one or more printheads of a printhead module eject a single color of ink. Typically, the printheads of one printhead module are offset by a distance that is one-half the distance between nozzles in a printhead from the printheads of another printhead module that ejects the same color of ink. This arrangement enables the two printhead modules to print at a higher resolution than the resolution provided by a single printhead module. By arranging a pair of printhead modules in this manner for each color of ink used in a CMYK printer, each color can be printed at the higher resolution. For instance, printhead modules 34A and 34B can deposit cyan ink, modules 34C and 34D can deposit magenta ink, modules 34E and 34F can deposit yellow ink, and modules 34G and 34H can deposit black. By offsetting or staggering the two printhead modules printing with the same color of ink, the resolution of a color separation can be increased from, for example, 300 dpi, the resolution printed by a single printhead module, to 600 dpi, the resolution printed by the pair of modules ejecting the same color. Although eight of the printhead modules 34 are illustrated, other numbers of printhead modules 34 can be provided.

As further shown, the printer 10 includes a substrate media supply and handling system 40, also known as a media transport. The substrate media supply and handling system 40, for example, can include sheet or substrate supply sources 42, 44, 46, and 48, of which supply source 48, for example, is a high capacity paper supply or feeder for storing and supplying image receiving substrates in the form of cut media sheets 49, for example. The substrate media supply and handling system 40 also includes a substrate handling and transport system 50 that has a substrate heater or pre-heater assembly 52 and a substrate and image heater 54. A fusing device 60 can optionally be provided to apply post-processing techniques to the images and the substrate. The printer 10 can also include an original document feeder 70 that has a document holding tray 72, document sheet feeding and retrieval devices 74, and a document exposure and scanning system 76.

Operation and control of the various subsystems, components and functions of the machine or printer 10 are performed with the aid of a controller or electronic subsystem (ESS) 80. The ESS or controller 80 is operably connected to the imaging drum 12, the printhead modules 34A-34H (and thus the printheads), the substrate supply and handling system 40, and the substrate handling and transport system 50. The ESS or controller 80, for example, is a self-contained, dedicated minicomputer having a central processor unit (CPU) 82 with electronic storage 84, and a display or user interface (UI) 86. The ESS or controller 80, for example, includes a sensor input and control circuit 88 as well as a pixel placement and control circuit 89. In addition, the CPU 82 reads, captures, prepares and manages the image data flow between image input sources, such as the scanning system 76, or an online or a work station connection 90, and the printhead modules 34A-34H. As such, the ESS or controller 80 is the main multi-tasking processor for operating and controlling all of the other machine subsystems and functions, including the printing process discussed below.

The controller 80 can be implemented with general or specialized programmable processors that execute programmed instructions. The instructions and data required to perform the programmed functions can be stored in memory associated with the processors or controllers. The processors, their memories, and interface circuitry configure the controllers to perform the processes, described more fully below, that enable the printer to perform drum maintenance unit (DMU) maintenance procedures and DMU cycles selectively. These components can be provided on a printed circuit card or provided as a circuit in an application specific integrated circuit (ASIC). Each of the circuits can be implemented with a separate processor or multiple circuits can be implemented on the same processor. Alternatively, the circuits can be implemented with discrete components or circuits provided in very large scale integrated (VLSI) circuits. Also, the circuits described herein can be implemented with a combination of processors, ASICs, discrete components, or VLSI circuits.

In operation, image data for an image to be produced are sent to the controller 80 from either the scanning system 76 or via the online or work station connection 90 for processing and output to the printhead modules 34A-34H. Additionally, the controller 80 determines and/or accepts related subsystem and component controls, for example, from operator inputs via the user interface 86, and accordingly executes such controls. As a result, appropriate color solid forms of ink are delivered to the printhead modules 34A-34H. Additionally, pixel placement control is exercised relative to the imaging surface 14 thus forming desired images per such image data, and receiving substrates, which can be in the form of media cut sheets 49, are supplied by any one of the sources 42, 44, 46, 48 and handled by substrate media transport system 50 in timed registration with image formation on the surface 14. Finally, the image is transferred from the surface 14 and fixedly fused to the image substrate within the transfix nip 18.

In some printing operations, a single ink image can cover the entire surface of the imaging drum 12 (single pitch) or a plurality of ink images can be deposited on the imaging drum 12 (multi-pitch). Furthermore, the ink images can be deposited in a single pass (single pass method), or the images can be deposited in a plurality of passes (multi-pass method). When images are deposited on the imaging drum 12 according to the multi-pass method, under control of the controller 80, a portion of the image is deposited by the printheads within the printhead modules 34 during rotation of the imaging drum 12.

In one type of printing architecture, images can be prepared by accumulating multiple color separations. During rotation of the imaging drum 12, ink droplets for one of the color separations are ejected from the printheads and deposited on the surface 14 of the imaging drum 12 until the last color separation is deposited to complete the image. In some cases, for example cases in which secondary or tertiary colors are used, one ink droplet or pixel can be placed on top of another one, as in a stack. Another type printing architecture generates images from multiple swaths of ink droplets ejected from the print heads. During rotation of the imaging drum 12, ink droplets for one of the swaths (each containing a combination of all of the colors) are applied to the surface of the imaging drum 12 until the last swath is applied to complete the ink image. Both of these examples of multi-pass architectures perform what is commonly known as "page printing." Each image comprised of the various component images represents a full sheet of information worth of ink droplets which, as described below, is then transferred from the imaging drum 12 to a substrate media.

In a multi-pitch printing architecture, the surface of the imaging drum can be partitioned into multiple segments, each segment including a full page image (i.e., a single pitch) and an interpanel zone or space. For example, a two pitch imaging drum is capable of containing two images separated by the interpanel zone, each corresponding to a single sheet of substrate media, during a revolution of the imaging drum 12. Likewise, for example, a four pitch imaging drum is capable of containing four images, each corresponding to a single sheet of substrate media, during a pass or revolution of the imaging drum.

Once an image or images have been printed on the imaging drum 12 under control of the controller 80 in accordance with an imaging method, such as the single pass method or a multi-pass method, the exemplary printer 10 begins a process for transferring and fixing the image or images at the transfix roller 19 from the imaging drum 12 onto the substrate media 49. According to this process, a sheet of substrate media 49 is transported by transport system 50 under control of the controller 80 to a position adjacent the transfix roller 19 and then through the nip 18 formed at the interface between the transfix roller 19 and imaging drum 12. The transfix roller 19 applies pressure against the back side of the substrate media 49 in order to press the front side of the substrate media 49 against the imaging drum 12. Although the transfix roller 19 can also be heated, in this exemplary embodiment, it is not. Instead, the pre-heater assembly 52 for the substrate media 49 is provided in the media path leading to the nip. The pre-heater assembly 52 provides the necessary heat to the substrate media 49 for subsequent aid in transfixing the image to the substrate media 49, thus simplifying the design of the transfix roller. The pressure produced by the transfix roller 19 on the back side of the heated substrate media 49 facilitates the transfixing (transfer and fusing) of the image from the imaging drum 12 onto the substrate media 49.

The rotation or rolling of both the imaging drum 12 and transfix roller 19 not only transfixes the images onto the substrate media 49, but also assists in transporting the substrate media 49 through the nip. The imaging drum 12 continues to rotate to continue the transfix process for the images previously applied to the surface 14 of the imaging drum 12. Any residual ink left on the imaging drum 12 can removed under control of the controller 80 by drum maintenance procedures performed at a drum maintenance unit (DMU) 92.

The DMU 92 is operably connected to the controller 80 such that components of the DMU 92 are selectively moved by the controller 80 into temporary contact with the rotating imaging drum 12 to deposit and distribute, for example, release agent onto imaging drum 12, and remove untransferred ink pixels from the surface of the imaging drum 12.

A problem presented in this printer 10 is that the insertion of the substrate media 49 into the transfix nip 18 forces a spreading of the transfix nip 18 by the thickness of the substrate media 49. This spreading is generally abrupt with the leading edge 120 of the substrate media 49, and is colloquially called a 'thump', with reference to a sound that may be produced at the same time. A similar 'thump' will occur upon a trailing edge 122 of a cut sheet of the substrate media 49 leaving the transfix nip 18 having been marked with the image, as the transfix nip 18 closes by the thickness of the substrate media 49. The energy used to climb an edge is called 'climb torque' or to fall off the edge is 'fall torque'.

As a first order approximation, the imaging drum 12 is considered to be the primary inertia source between imaging drum 12 and transfix roller 19. In the exemplary embodiment herein, the imaging drum 12 is of a larger diameter, for example only, approximately 21.75 in., than the transfix roller 19, depicted herein on the order of approximately 8 in. diameter. The precise dimensions of either the imaging drum 12 or the transfix roller 19, in the abstract or in relation to one another, is not critical to the present disclosure, except to the extent that the stated approximation holds.

If it is considered that no external torque is applied to the system, the work done in separating the imaging drum 12 from the transfix roller 19, held together under the transfix force 21, by a distance equal to the thickness of the paper must equal the change in rotational kinetic energy of the system, which for small changes in rotational velocity, can be approximated by the equation $$\Delta\omega = -\frac{Fx}{\rho 2\pi L t r^3 \omega}$$

where F is the magnitude of the transfix force 21; x is the thickness of the substrate media 49; ρ the density of the material making up the wall of the imaging drum 12; L is the length of the imaging drum 12; t is the wall thickness of the imaging drum 12, r is the radius of the imaging drum 12, and ω is the nominal rotational speed of the imaging drum 12. For a test case, we presume a 21.75 in. diameter imaging drum 12 that is 17 in. in length and has a 0.75 in. thick wall, with a surface velocity of the imaging drum 12 and the substrate media of 1.0 m/s. A paper thickness of about 250 μm translates the width of the printing nip 18, subject to a transfix force 21 of about 17 kN, in about 919 ms; giving a work of about 0.18 kW to be extracted from the rotational energy of the system. Under those circumstances, we can expect an approximate 8% reduction in rotational speed of the system upon the entry of the substrate media 49 into the transfix nip 18. The rotational speed reduction increases both with the magnitude of the transfix force 21, and the thickness x of the substrate media 49.

One method contemplated according to the present disclosure to address this disruption to the rotational motion of the imaging drum and avoid image artifacts owing to a resulting degradation in motion quality is to provide a supplemental torque to the system coincident with the arrival and/or departure of the substrate media 49 from the transfix nip 18. The supplemental torque will act to preserve the constant rotational speed of the system. In the presently described embodiment it is considered that the imaging drum 12 is driven by a motor (not shown), with a speed and direction determined by motor drive unit, either separable or integrated with and/or controlled by controller 80. The transfix roller 19 is riding along idle against the imaging drum 12, under the influence of the transfix force 21. In other embodiments the transfix roller 19 may be powered as well by means other than its engagement with the imaging drum 12. A drive train may connect the motor with the imaging drum 12, to include a transmission such as a timing belt, gear, serpentine belt, cone worm drive or the like, and optionally a detachable transmission having a clutch mechanism, including one controlled by controller 80.

It is necessary to determine the time of arrival of the substrate media 49 at the transfix nip 18 in order to coincide the application of the supplemental torque to the rotational system. One means of doing so includes a substrate sensor 22 upstream of the transfix nip 18. Substrate sensor 22 may be one or more of an edge sensor, a photoelectric sensor, a proximity sensor, or the like. As an example in the presently described embodiment, the substrate media 49 is a cut sheet, which will present a leading edge 120 and a trailing edge 122 to the transfix nip 18 in the course of marking a single image on the substrate media 49. Substrate sensor 22 would output to a controller, for example controller 80, for coordination of the supplemental torque application to imaging drum 12. Also, a rise in motor current due to the climb torque with a sensing resistor can be used to verify the sheet arrival and further adjust the feed forward gain required to compensate for the effect and manage the drive assist servo motor gain and band width.

The transfix force 21 will be either predetermined and/or measured, as will the thickness of the substrate media 49. The physical properties of the rotational system as described above relevant to the first-order approximation of the change in rotational velocity will either be known or, for example with regard to rotational speed, predetermined or measured. The substrate sensor 22 will detect the leading edge 120 of the substrate media 49 approaching the transfix nip 18 at a detection threshold 23, the detection threshold being the point in space where the substrate media 49 is detected by the substrate sensor 22. When the substrate media 49 reaches the detection threshold 23, the substrate sensor 22 generates a corresponding signal which it transmitted to the motor drive. The duration of the climb torque can also be used to determine the sheet thickness. For example, and for a certain process speed, 100 μm thickness corresponds to 12 ms, 250 μm to 19 ms, and 350 μm to 22 ms. The gain values for the feed forward circuit can be tabled for the different sheet thicknesses.

In a further refinement, knowing the rotational speed of the imaging drum 12 and/or the corresponding speed of the substrate media 49 in the process direction, along with a known or measured distance from the detection threshold 23 to the transfix nip 18, the timing of the interface between the substrate media 49 and transfix nip 18 can be predicted. Compensation for the distance between the detection threshold 23 and the transfix nip 18 can be made by either or both of delaying the output signal from the substrate sensor 22, or delaying the onset of the torque compensation to the imaging drum 12.

The response to a detection signal output from the substrate sensor 22, and more particularly to a rising edge of the signal output from the substrate sensor 22, with optional consideration of the time of arrival of the corresponding edge of the substrate media 49 at the transfix nip 18, the torque applied to the imaging drum 12 may be adjusted to compensate for the anticipated rotational speed disruption. More specifically, the torque may be increased corresponding with the arrival of a leading edge 120 at the transfix nip 18 and the resultant spreading of the transfix nip 18, in order to maintain a constant rotational speed of the imaging drum 12. Furthermore, the torque may be decreased upon the arrival of the trailing edge 122 at the transfix nip 18, as indicated by a falling edge of the signal output from the substrate sensor 22, to correspond to the closing of the transfix nip 18 upon departure of the trailing edge 122, again to maintain a constant rotational velocity of the imaging drum 12.

The foregoing arrangement has been tested in prototype, and determined to reduce the variation in the rotational speed of the imaging drum 12 related to the 'thump' by up to a factor of 3. However, further improvement is still possible. For example, the time of travel between the detection threshold 23 and the transfix nip 18 requires some measure of prediction. This prediction can be frustrated by variations in the speed of the substrate media 49, or of the imaging drum 12, and skew or curl in the substrate media 49 that could cause the arrival of the leading edge 120 of the substrate media 49 to differ from the prediction. The system is therefore enhanced by a more reliable and direct method for detection of the substrate media 49 entering the transfix nip 18.

Figure 2:
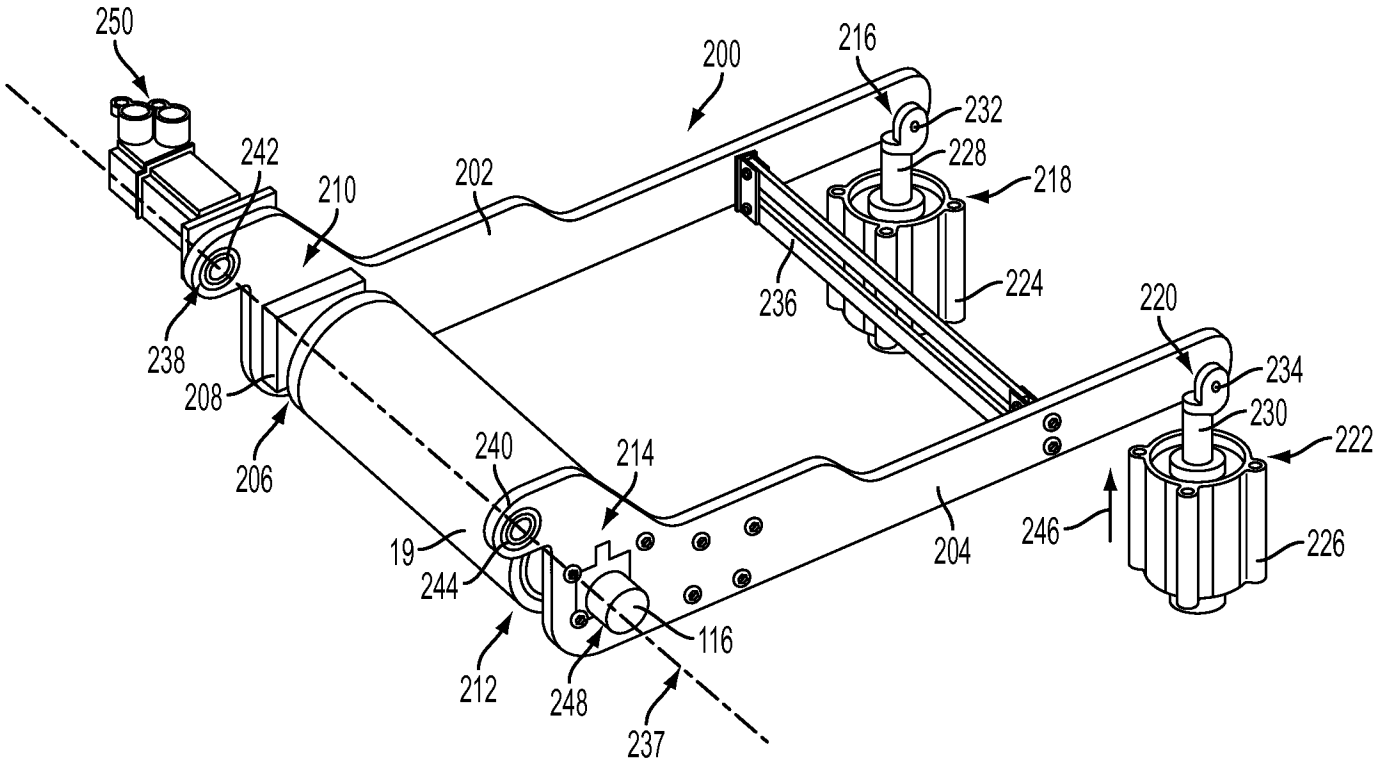
FIG. 2 illustrates a transfix roller and engagement frame according to a further embodiment of the present disclosure.

Referring now to FIG. 2, the transfix roller 19 engages the imaging drum 12 (not shown) from beneath the imaging drum 12 with an applied force provided by a load mechanism 200. The load mechanism 200 includes a first arm 202 and a second arm 204 each of which support the transfix roller 19 for rotation about its axis 116. The transfix roller 19 includes a first end 206 supported by a first bearing block 208 operatively connected to an end 210 of the first arm 202. The transfix roller 19 also includes a second end 212 supported by a second bearing block (not shown) similar to the first bearing block, at an end 214 of the second arm 204. An end 216 of first arm 202 is operatively connected to an actuator 218 and an end 220 of the second arm 204 is operatively connected to an actuator 222. Each of the actuators 218 and 222 include respectively a housing 224 and 226 and a rod 228 and 230. The rods 228 and 230 are rotatably operatively connected to the ends 216 and 220 at pivots 232 and 234, respectively. A support arm 236 connects the first arm 202 to the second arm 204 to provide a stable support structure. The actuators 218 and 222 can be implemented as any of a variety of actuators including cam and cam followers, linear actuators and pneumatic cylinders, without limitation. For example, actuators 218 and 222 are depicted in FIG. 2 as linear piston-cylinder actuators, driven by a motive fluid such as air or hydraulic fluid. Actuators 218 and 222 may alternately be rotary actuators, step- or servo-motor driven, or any suitable means for applying the transfix force 21 to the transfix roller 19.

To provide a constant force to the image drum 12, the roller 19 is moved into engagement with the imaging drum 12 through movement of the ends 216 and 220 by actuators 218 and 222 about an axis 237. To provide rotation about the axis 237, the end 210 of first arm 202 and the end 214 of second arm 204 include respectively extending portions 238 and 240. Each of the extending portions 238 and 240 include apertures 242 and 244 respectively supporting bearings through which a shaft (not shown) is supported along the axis 237. The shaft and the actuators 218 and 222 are fixedly operatively connected to a frame 11 of the printer such that the shaft and actuators remain stationary with respect to the frame 11 and the imaging drum 12.

To apply a force to the transfix roller 19, each of the actuators 218 and 222 apply an upward force in a direction 246 through actuation of the rods 228 and 230. Upward movement (as illustrated) of the ends 216 and 220 cause the arms to rotate about the axis 237 and move the transfix roller 19 into contact with the imaging drum 12. Other configurations are possible such that the rods 228 and 230 are moved in other directions depending on the arrangement of the transfix roller 19 with respect to the imaging drum 12. The actuators are operatively connected to a controller, such as controller 80, which generates signals to move the actuators 218 and 222 in the designated direction. Similarly the load mechanism 200 need not necessarily rotate around axis 237, but may be mounted for linear and/or compound motion to apply the transfix force 21 to the transfix roller 19.

In one embodiment, the distance between the axis 237 of the shaft and the axis 116 of the transfix roller 19 is five (5) inches. The distance between the axis 116 and the point of rotation for each arm 202 and 204 about pivots 232 and 234 is 30.4 inches. Consequently, a six to one ratio is developed to provide a mechanical advantage for applying the amount of force necessary to the substantially continuous transfix nip 18.

The load mechanism 200 can optionally include an encoder 248 operatively connected to one end, in this case the second end 212, of the transfix roller 19 to identify the rotational speed of the transfix roller 19 and consequently the linear speed of a sheet of substrate media 49, with feed back to a controller, e.g., controller 80. Optionally, a drive motor 250 can be operatively connected to the first end 206 to provide a powered transfix roller 19. In other embodiments, the motor 250 can be eliminated, leaving the transfix roller 19 an idle roller against the driven imaging drum 12.

Using the arrangement depicted in FIG. 2, upon engagement of the substrate media 49 with the transfix nip 18, a force feedback will be detectable in the load mechanism 200 by reason of the spreading of the transfix nip 18. There are a variety of feedback paths. For example, feedback may be detected by changes to the fluid pressure driving actuators 218 and/or 222. Force feedback may be detected by strain in the load mechanism 200, for example in first or second arms 202 and/or 204, by an appropriately located load cell or strain gauge. A motion, proximity, and/or photoelectric sensor or the like may be configured to detect motion in the transfix roller 19, for example at its longitudinal axis 116, as means for detecting the entry of the substrate media 49 into the transfix nip 18.

In an earlier application commonly assigned with the present patent application Ser. No. 13/218,622, filed 26 Aug. 2011 and entitled ACTIVE DECURLER ADJUSTMENT USING ELECTRICALLY CONDUCTIVE PRESSURE ROLLERS, the complete disclosure of which is hereby incorporated by reference, a particular roll material is disclosed that exhibits varying electrical properties with reference to its state of compression. A transfix roller 19 including such material may be used to electrically detect the engagement of the substrate media 49 with the roll nip 18 by the change in electrical properties of the transfix roller 19 by reason of the compression.

Figure 3:
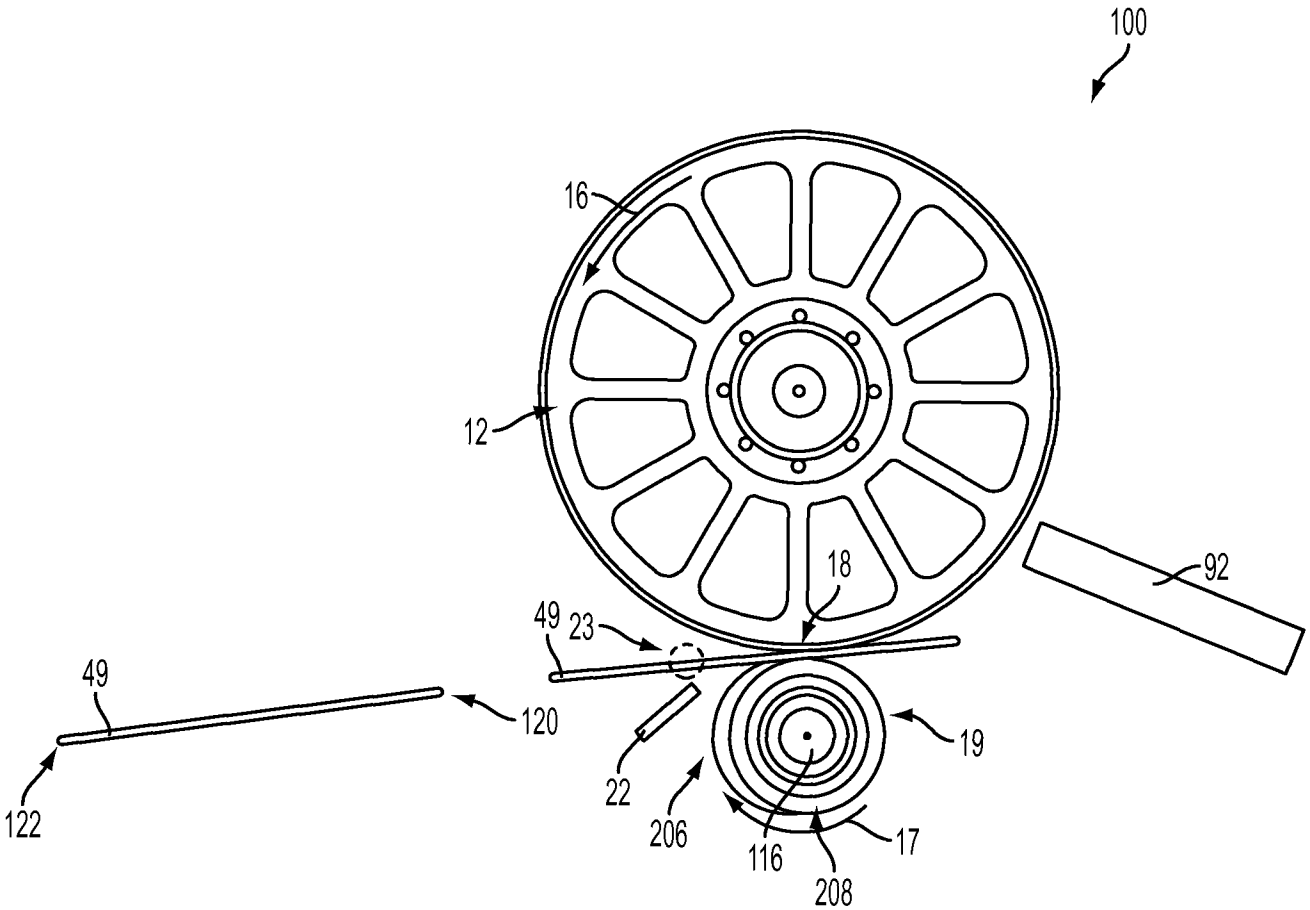
FIG. 3 illustrates a transfix nip formed by a skewed transfix roller according to a still further embodiment of the present disclosure.

Furthermore, in an earlier and commonly assigned application Ser. No. 13/495,483, filed 13 Jun. 2012 by Roger G. Leighton, et al., and entitled PRINTER HAVING SKEWED TRANSFIX ROLLER TO REDUCE TORQUE DISTURBANCES, the complete disclosure of which is hereby incorporated by reference, it is disclosed that in a transfix direct marking engine, the axis of one of the rolls firming the transfix nip 18, typically the transfix roller 19, is skewed with respect to the axis of the imaging drum. As disclosed therein, the skew is on the order of about 2 degrees. This is disclosed to further reduce motion quality disturbances. More specifically, the skew angle reduces the abrupt edge step change by climbing up the corner of the paper. Such an arrangement is depicted in FIG. 3.

Using such a skewed transfix roller 19, the opposite ends 206, 212 of the transfix roller 19 are displaced along the process direction with respect to one another. In that arrangement, it is preferable to detect the entry of the substrate media 49 into the transfix nip 18 on the side of the transfix roller 19 that is upstream in the process direction. For example, in the case of Applicant's present FIG. 2, consider that the load mechanism 200 is configured to advance the first side 206 of the transfix roller 19 with respect to the process direction. The second side 212 would trail the first side 206, creating a skew angle with respect to the imaging drum. In that case, detection of substrate media 49 engagement with the transfix nip 18 would be performed with reference to the far side of the load mechanism 200, i.e., first arm 202 and/or actuator 218. This helps to ensure the earliest possible detection of substrate media 49 entry into the transfix nip 18.

It will be appreciated by those skilled in the art that certain alterations or modifications of the system and methods of the present disclosure, including their features and functions, or alternatives thereof, may be apparent. Among these, except as specifically disclosed otherwise, or to the extent that they are mutually exclusive, any of the features and aspects of the various embodiments disclosed herein may be combined with one another in any of their possible permutations or combinations. The same may be desirably combined into many other different systems or applications. The systems and methods disclosed are offered as merely exemplary of, and not liming on, the scope of the present disclosure. Various presently unforeseen or unanticipated alternatives, modifications, variations, or improvements therein may be subsequently made by those skilled in the art which are also intended to be encompassed by the following claims.

We claim:

1. A printer for the direct marking of document images on a substrate, the printer comprising:

an imaging drum having a first longitudinal axis, and mounted for rotation around the first longitudinal axis, the imaging drum operative to receive a pattern of marking ink corresponding to an image to be printed on the substrate;

a transfix roller having a second longitudinal axis and mounted for rotation around the second longitudinal axis, the transfix roller being selectively held against the imaging drum by a transfix force, the interface of the imaging drum and the transfix roller forming a transfix nip having a nip width, wherein an image is formed on the substrate passed through the transfix nip by the marking ink deposited on the imaging drum;

a motor;

a drive train operatively connecting the motor to the imaging drum;

a motor drive unit controlling the speed and direction of the motor, to drive the imaging drum with a corresponding speed and direction; and a substrate sensor operative to detect the substrate entering into or exiting from the transfix nip, and to output a signal to the motor drive unit based upon the detection, wherein the motor drive unit varies the torque applied to the imaging drum in response to the signal from the substrate sensor, the variation in torque being sufficient to maintain a constant rotational speed of the imaging drum notwithstanding the substrate passing through the transfix nip.

2. A printer according to claim 1, wherein the substrate sensor is one of a photoelectric or proximity sensor, and is positioned and configured to detect the presence of the substrate crossing a detection threshold upstream in a process direction from the transfix nip.

3. A printer according to claim 2, wherein the motor drive unit varies the timing of the motor drive response to the signal output from the substrate sensor, corresponding the variation in applied torque to coincide with the substrate entering into or exiting from the transfix nip, based upon a distance between the detection threshold and a presumed or measured speed of the substrate in the process direction.

4. A printer according to claim 2, wherein the substrate sensor varies the timing of the signal output from the substrate sensor, corresponding the signal output to coincide with the substrate entering into or exiting from the transfix nip, based upon a distance between the detection threshold and a presumed or measured speed of the substrate in the process direction.

5. A print ending according to claim 1, wherein the second longitudinal axis is skewed relative to the first longitudinal axis, whereby a first end of the transfix roller is upstream in the process direction compared with an opposite second end of the transfix roller.

6. A printer according to claim 5, wherein the second longitudinal axis is skewed relative to the first longitudinal axis at an angle of about 2 degrees.

7. A printer according to claim 5, wherein the substrate sensor is configured to detect the substrate entering into or exiting from the transfix nip at the first end of the transfix roller.

8. A printer according to claim 1, wherein the substrate sensor is operative to detect a change in the dimension of the transfix nip resulting from the substrate entering into or exiting from the transfix nip.

9. A printer according to claim 8, wherein the transfix roller comprises a material that exhibits varying electrical properties according to its state of compression, and the substrate sensor detect the variable electrical properties of the transfix roller.

10. A printer according to claim 1, further comprising:

an engagement frame, the transfix roller being rotatably mounted to the engagement frame; and an actuator positioned to act on the engagement frame to press the transfix roller into engagement with the imaging drum.

11. A printer according to claim 10, wherein the substrate sensor detects strain in the engagement frame related to the substrate entering into or exiting from the transfix nip.

12. A printer according to claim 10, wherein the substrate sensor detects force feedback in the actuator related to the substrate entering into or exiting from the transfix nip.

13. A printer according to claim 12, wherein the actuator is driven by a motive fluid, and the force feedback detected by the substrate sensor is a variation in the motive fluid pressure.

14. A printer according to claim 12, wherein the actuator is driven by electric power, and the force feedback detected by the substrate sensor is a variation in the amperage drawn by the actuator.

15. A printer according to claim 1, the substrate having a leading edge and a thickness, and wherein the motor drive responds to signal output from the substrate sensor corresponding with the leading edge of the substrate entering into the transfix nip by increasing the torque applied to the imaging drum in an amount corresponding to the work required to separate the transfix nip by the thickness of the substrate in the time required for the leading edge to cross the nip width at the velocity of the substrate in the process direction.

16. A printer according to claim 1, the substrate having a trailing edge and a thickness, and wherein the motor drive unit responds to signal output from the substrate sensor corresponding with the trailing edge of the substrate exiting from the transfix nip by decreasing the torque applied to the imaging drum in an amount corresponding to the work required to close the transfix nip by the thickness of the substrate in the time required for the trailing edge to cross the nip width at the velocity of the substrate in the process direction.

17. A printer according to claim 1, wherein the transfix roller is idle, and is rotated by engagement with the imaging drum.

* * * * *